United States Patent [19]

Kellis

[11] Patent Number: 4,795,659

[45] Date of Patent: Jan. 3, 1989

[54] FABRICATION OF MERCURY SWITCHES

[75] Inventor: Timothy M. Kellis, Blacksburg, Va.

[73] Assignee: American Telephone and Telegraph Company, AT&T Bell Laboratories, Murray Hill, N.J.

[21] Appl. No.: 80,925

[22] Filed: Aug. 3, 1987

[51] Int. Cl.[4] ..... B05D 5/12; H01H 11/02

[52] U.S. Cl. ..... 427/123; 427/242; 29/622; 29/756; 29/460

[58] Field of Search ..... 29/622, 602 R, 756, 29/460; 427/123, 241, 242; 335/58

[56] References Cited

U.S. PATENT DOCUMENTS

| | | | |
|---|---|---|---|
| 3,021,231 | 2/1962 | Samuel et al. | 427/242 |
| 4,368,442 | 1/1983 | Yamaguchi et al. | 29/622 |
| 4,630,359 | 12/1986 | Hill et al. | 29/602 R |

*Primary Examiner*—P. W. Echols

*Attorney, Agent, or Firm*—Lester H. Birnbaum

[57] ABSTRACT

Disclosed is a method of fabricating mercury switches. The switches are actived by loading a batch into a common housing of a fixture. The fixture is then rotated in a furnace at a slow speed to prevent breakage. The fixture may include a mesh cage housing to allow rapid heating and cooling.

7 Claims, 3 Drawing Sheets

FABRICATION OF MERCURY SWITCHES

BACKGROUND OF THE INVENTION

This invention relates to the fabrication of mercury switches.

A mercury switch typically comprises a contact member which is contacted by an armature activated by some magnetic means in order to close the switch. A layer of mercury coats the armature and contact member in order to provide a low resistance contact. The elements of the switch are sealed within a glass tube. The tube also includes a pool of mercury which replenishes the mercury depleted from the armature and contact area. The switches are usually fabricated by including a ball of mercury and desired dopants in the glass tubes and then activating the switches by rotating them while heating in a furnace to permit the mercury to wet the armature and the contact member, and to permit the dopants to react with the members to form any desired protective layers.

In a typical prior art method of switch activation, each switch is loaded into an individual compartment of a block which includes many compartments. Each compartment is approximately the same size as a switch. The block is then inverted over a fixture which also has individual compartments corresponding to those of the block, so that each switch falls into its individual fixture compartment. Each fixture compartment can be the same size as, or slightly larger than, the switch. The fixture is covered and then rotated on a pair of rollers in a furnace, typically at a temperature of approximately 420° F. for 3 hours where the roller speed is 250 RPM.

While adequate, such a process for activating the switches is time consuming in the loading operation. In addition, the fixture, which is typically made of stainless steel, takes a fairly long period of time to heat up and cool down (typically, approximately 25–30 minutes).

It is, therefore, an object of the invention to provide a more efficient method of fabricating mercury switches.

SUMMARY OF THE INVENTION

This and other objects are achieved in accordance with the invention which is a method of fabricating mercury switches which include a source of mercury and metallic members within a glass tube. A plurality of the switches are loaded into a common housing of a fixture element. The fixture element is then rotated while heating for a time and temperature sufficient to cause the mercury to wet the surface of the metallic members.

BRIEF DESCRIPTION OF THE DRAWING

These and other features of the invention are delineated in detail in the following description. In the drawing.

It will be understood that, for purposes of illustration, these figures are not necessarily drawn to scale.

DETAILED DESCRIPTION

Figure 1:
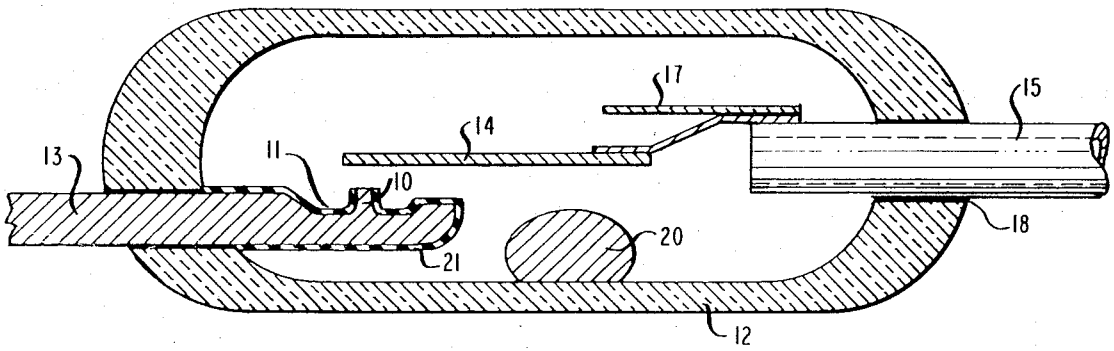
FIG. 1 is a cross-sectional view of a mercury switch at a stage of fabrication prior to activation.

FIG. 1 illustrates a type of switch which can make use of the method of the invention. A metal contact, 10, is formed on a pole piece 11, which extends within a breakable glass envelope 12. The contact, 10, is typically made of a copper-nickel alloy, the pole piece is typically a nickel-iron alloy and the glass envelope is typically made of silicon dioxide. Included over the pole piece and all but the top surface of the contact is a layer, 21, of chromium oxide which serves to restrict the area for subsequent mercury wetting. The envelope is sealed by melting the glass to the pole piece. Mounted above the contact is an armature, 14, which is typically a nickel-iron alloy. The armature, 14 is mechanically coupled to a stem, 15, by spring means, which in this example is a combination of hinge spring, 16, and damper spring, 17. Again, the glass is melted to seal the armature. A ball, 20, comprising mercury is included within the envelope Dopants, such as copper and tin, may also be included within the envelope, but are not shown here.

It is desired to activate such a switch by coating the components within the envelope with a mercury film and, when dopants are present, to form a protective layer between the components and mercury film.

Figure 2:
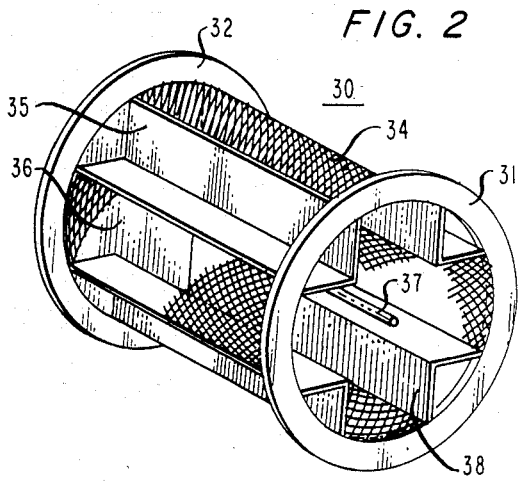
FIG. 2 is a perspective view of a fixture which may be utilized in accorance with one embodiment of the invention.

In order to accomplish this activation, the invention makes use of a fixture such as that shown as 30 of FIG. 2. It will be noted that the fixture includes a pair of circular rims, 31 and 32, and a housing of generally cylindrical shape between the rims. The housing can be strictly a cylinder, but in this embodiment it comprises wall portions, 34, which follow the contour of the rims 31 and 32, and indent portions, 35, which permit gripping of the housing. The wall portions, 34, comprise a mesh material, which in this example was 28 size stainless steel mesh (28 mil diameter holes), although other types of material can be employed consistent with the objectives of the invention. The mesh is secured to the fixture by welding to the outside of the indent portions, 35, which are made of solid stainless steel. The bottom surface, 36, of the fixture and the rim 32 are made of a single piece of stainless steel. Extending from the bottom surface is a rod, 37, which engages a recess in a cover (39 of FIG. 4) so that the cover may be secured thereto.

Figure 3:
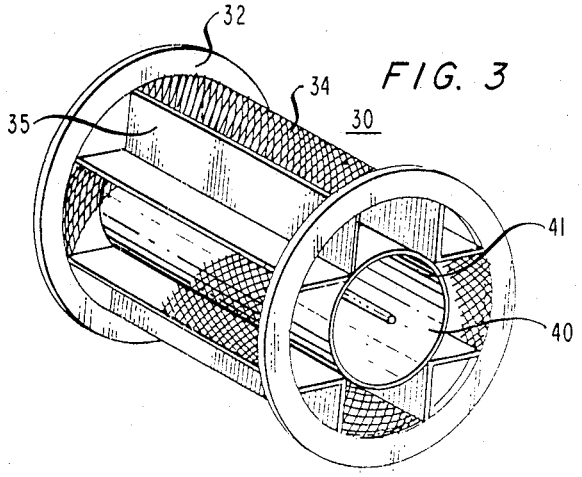
FIG. 3 is a perspective view of another fixture which may be used in accordance with one embodiment of the invention.

The wall and indent portions (34 and 35, respectively) define a housing, 38, for receiving a plurality of switches of the type shown in FIG. 1. Typically, approximately 2000–4000 of such switches are loaded into the housing and the housing covered so that further processing may be effected as described below. As shown in FIG. 3, where the same elements are similarly numbered, the fixture could include a cylindrical member, 40, inserted within the housing, 38, to define a smaller housing, 41, for containing the switches. This cylindrical housing eliminates contact of the switches with the edges of the indent portions to provide a smoother surface for the switches in the subsequent processing. The element was made of stainless steel, but other suitable materials could be employed.

Figure 6:
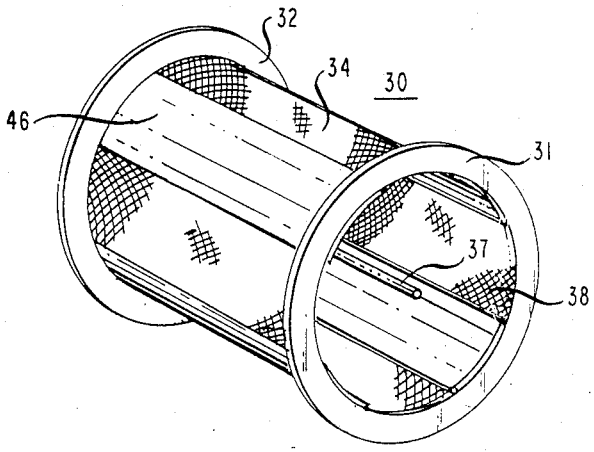
FIG. 6 is a perspective view of yet another fixture which may be used in accordance with one embodiment of the inventions.

As shown in FIG. 6, where the same elements are similarly numbered, the indent portions, 35, can be replaced by brackets, 46 which follow the contours of the rims 31 and 32. Here, the mesh portions, 34, are welded to the inside of the brackets 46. The cylindrical member, 40, is removed since the fixture housing 38 is now cylindrical.

Figure 4:
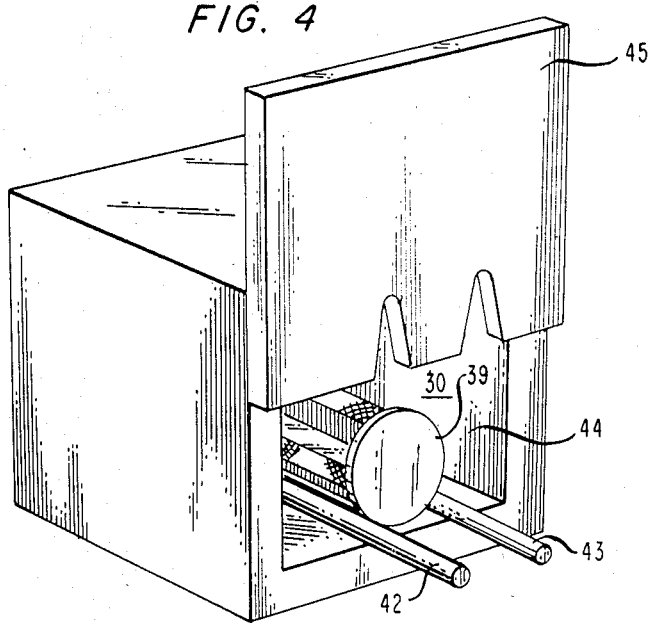
FIG. 4 is a perspective view of the fixture during one stage of fabrication in accordance with one embodiment of the invention.

After a plurality of switches is loaded into the housing of the fixture and covered, the fixture is placed in a furnace such as that shown in FIG. 4. The fixture rests on a pair of rollers, 42 and 43, which extend within the furnace chamber 44. The furnace door, 45, is brought down over the chamber opening, the furnace heated to a desired temperature, and the rollers rotated by some means (not shown) so that the fixture rotates while being heated in the furnace. A normal rotation speed for the rollers in prior art processes is approximately 250 RPM. In the present process, a considerably slower rotation speed is desirable to insure that the switches within the common housing do not break. Specifically, the rotation speed in this example is 10 RPM, but speeds within the range 10–50 RPM would be useful. The furnace is typically heated to a temperature of 350° F., although a range of 300° F.–400° F. may be appropriate. Heating times are typically in the range 30 minutes–1 hour.

Figure 5:
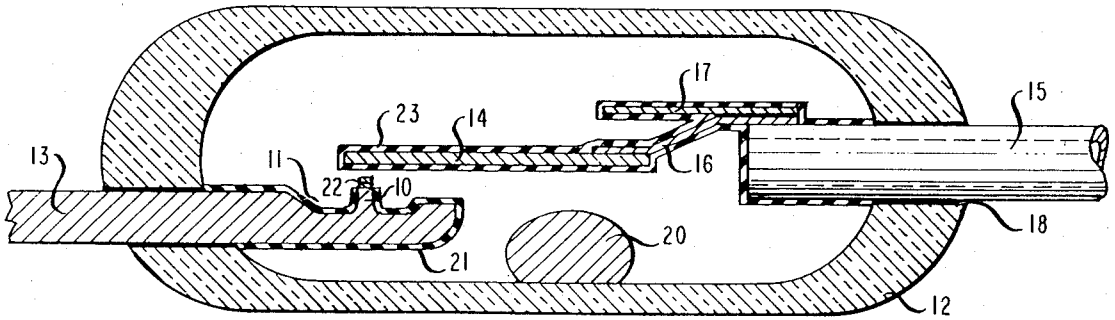
FIG. 5 is a cross-sectional view of a mercury switch subsequent to the fabrication stage illustrated in FIG. 4.

At the end of the heating cycle, the fixture is removed from the furnace and allowed to cool. The switches are removed from the fixture and have the general appearance illustrated in FIG. 5. As a result of activation, a layer, 22, of mercury is formed on the portion of contact 10 not covered by oxide layer 21, and a layer, 23, of mercury is also formed on the surface of the armature, 14, springs 16 and 17, and stem 15. The switch is then ready for further assembly, such as mounting within a coil (not shown) to provide the magnetic means for operating the switch.

Several advantages accrue from practicing the method according to the invention. Since the switches are batch loaded into a common housing rather than individually loaded into separate compartments, a considerable amount of time and labor is saved in the processing. Further, the use of a fixture with mesh walls (34) allows the switches to heat up and cool down faster than prior art processes generally permit, thus saving additional time. For example, in a typical prior art process using a fixture with solid metal walls, the switches achieved peak temperature in about 25–30 minutes, and cooled to room temperature in about 30–35 minutes. With the present fixture, it took only 10 minutes to heat up and 15 minutes to cool down. Furthermore, the fixture was lighter and therefore easier to handle.

If desired, a combination of fixtures could be used for an activation. For example, switches could be activated in the fixture of FIG. 2 during a first phase where greater agitation is desired (due to indent portions 35). In a second phase, the switches could b loaded into the fixture of FIGS. 3 or 6 for the remainder of the heating cycle.

Various additional modifications of the invention as described will become apparent to those skilled in the art. All such variations which basically rely on the teachings through which the invention has advanced the art are properly considered within the scope of the invention.

What is claimed is:

1. A method of fabricating mercury switches which include a source of mercury and metallic members within a glass tube, the method comprising the steps of:

loading a plurality of switches into a single common housing of a fixture element and rotating the fixture element while heating for a time and temperature sufficient to cause the mercury to wet the surface of the metallic members.

2. The method according to claim 1 wherein the fixture is rotated on rollers with a speed of 10–50 RPM.

3. The method according to claim 1 wherein the fixture element includes a wall comprising a mesh material.

4. The method according to claim 1 wherein the fixture element is heated at a temperature in the range 300° F.–400° F. for a time in the range 30 minutes–1 hour.

5. The method according to claim 1 wherein the common housing is cylindrical.

6. The method according to claim 1 where the fixture includes portions which are indented into the housing.

7. The method according to claim 1 wherein the mercury wets essentially the entire surface of the metallic members within the glass tube.

* * * * *